United States Patent [19]

Dyett et al.

[11] Patent Number: 4,621,650

[45] Date of Patent: Nov. 11, 1986

[54] CIGARETTE MAKING MACHINE

[75] Inventors: Derek H. Dyett; Michael J. Soborowski, both of High Wycombe, England

[73] Assignee: Molins Machine Co., Inc., United Kingdom

[21] Appl. No.: 563,616

[22] Filed: Dec. 20, 1983

[30] Foreign Application Priority Data

Sep. 13, 1983 [GB] United Kingdom ..... 8324510

[51] Int. Cl.[4] ..... A24C 5/52; A24C 5/32

[52] U.S. Cl. ..... 131/282; 131/94

[58] Field of Search ..... 131/282, 283, 94; 198/457, 436, 480, 481

[56] References Cited

U.S. PATENT DOCUMENTS 1,777,048 9/1930 Molins ..... 198/457

4,055,192 10/1977 Berlin et al. ..... 131/84 B

FOREIGN PATENT DOCUMENTS 0290675 11/1931 Italy ..... 198/457

*Primary Examiner*—V. Millin

*Attorney, Agent, or Firm*—Antonelli, Terry & Wands

[57] ABSTRACT

Cigarettes are fed from the rod line into a laterally moving fluted drum (1) by a rotating snail cam having a cigarette contacting surface (5) of constant radius over part of its length (arc A) and of increasing radius over a further part (arc B). The cigarettes are accelerated lengthwise over arc (A) with suction being applied to grip the cigarettes, and afterwards sideways acceleration is imparted to the cigarettes over arc (B) while the leading end of each cigarette is being displaced sideways at the same speed by the trailing wall 2*b* of the flute (2) receiving the cigarette.

In an alternative construction in which the cigarettes are deflected by a wheel having helical grooves formed in its peripheral surface, a straight portion is provided at the start of each groove to impart only linear acceleration to the cigarettes.

19 Claims, 4 Drawing Figures

CIGARETTE MAKING MACHINE

This invention is generally concerned with devices for receiving cigarettes and other rod-like articles moving axially in abutting endto-end relationship and for transferring them to a laterally moving conveyor, commonly a fluted drum, which subsequently carries the articles sideways. In a cigarette-making machine, such a device may for example be immediately downstream of the cut-off which severs the continuous cigarette rod into separate cigarette lengths. One device for this purpose, as described in U.S. Pat. No. 3,039,589, comprises an accelerator in the form of a helically grooved wheel which rotates with a peripheral speed slightly greater than the axial speed of the cigarettes and has ports in the grooves communicating with an internal suction chamber so that the cigarettes are successively gripped by suction in the groove or grooves and are accelerated axially while at the same time being moved slightly laterally. Thus the cigarettes arrive on the conveyor with a component of motion in the same direction as the conveyor.

There is a tendency for the device described in the abovementioned patent to tilt each cigarette so that it is no longer parallel with the wall of the flute in the lateral conveyor into which it is being fed. This can cause damage to the cigarettes, especially if they are relatively long. The latter situation occurs particularly if the cigarettes at this stage are double-length rods which are subsequently cut in half. One object of this invention is the avoidance or reduction of the tendency for such double-lengths to be damaged as a result of tilting during the transfer operation.

According to the present invention there is provided a machine for making cigarettes or other rod-like articles by cutting rod sections from a continuous rod, including a conveyor for carrying the articles sideways, and deflector means which receives the articles while they are moving axially and feeds them forwards at an increased speed on to the conveyor and imparts to the articles a sideways component of movement in the direction of movement of said conveyor, said deflector means having an article contacting surface comprising a first portion which is arranged to accelerate substantially only in an axial direction, each article in contact with said first portion, and a second portion arranged thereafter to impart on each said article a sideways component of movement substantially in the direction of movement of the adjacent portion of the conveyor.

In a preferred arrangement said deflector means is in the form of a snail cam, the peripheral surface of which constitutes said article contacting surface. The first portion of said surface is of constant radius and is provided with ports through which suction is applied to grip said articles during said axial acceleration; and said second portion of said surface is of increasing radius such that the velocity of said sideways movement of said articles is substantially equal to the velocity of said conveyor.

According to a further aspect of the invention there is provided a machine for making cigarettes or other rod-like articles by cutting rod sections from a continuous rod, including a fluted conveyor for carrying the articles sideways, first feed means arranged to impart sideways movement to said articles starting substantially at the moment when the leading end portion of each successive article comes into contact with a side wall of a flute in said conveyor. Said second feed means is preferably arranged to impart to said articles a sideways velocity substantially equal to the velocity of said fluted conveyor.

The invention will now be described, by way of example only, with reference to the accompanying drawings in which.

Figure 1:
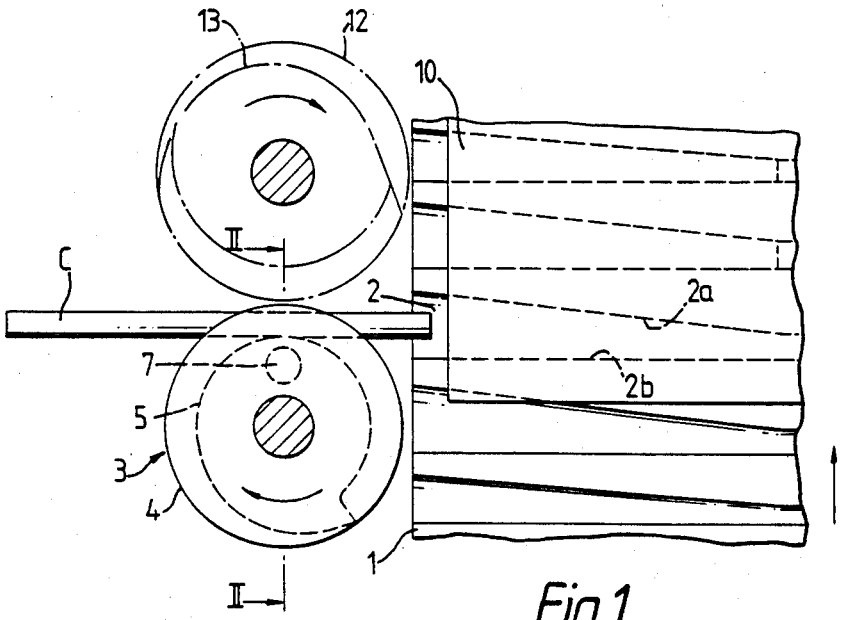
FIG. 1 is a diagrammatic front view of part of a cigarette machine showing one form of cigarette deflector embodying the present invention.
Figure 2:
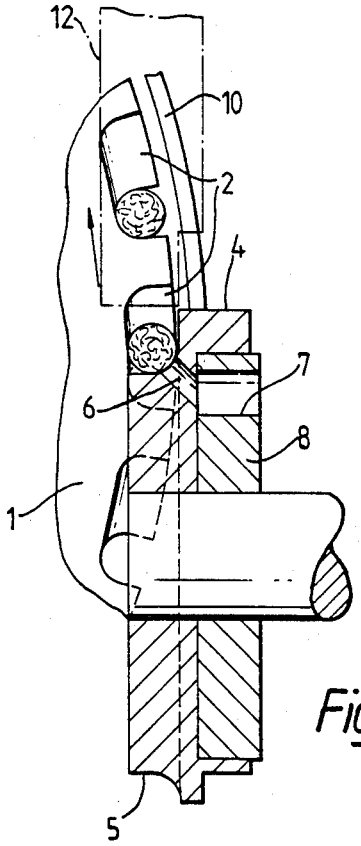
FIG. 2 is a section taken on the line II—II of FIG. 1 and drawn to a larger scale.
Figure 3:
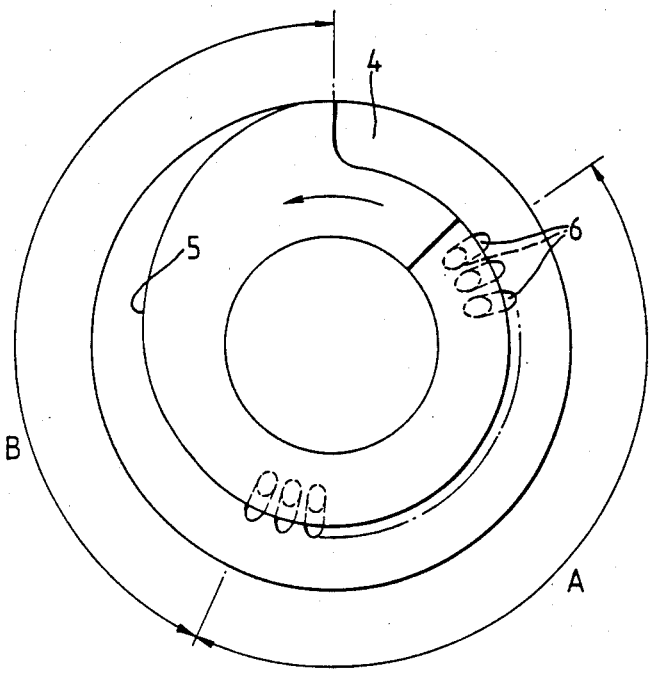
FIG. 3 is a detail of part of the apparatus of FIG. 1 and drawn to a larger scale.

Referring to FIGS. 1, 2 and 3 of the drawings cigarette lengths C of twice the length of that required in a finished cigarette are cut from a continuous rod and fed towards a fluted conveyor drum 1, having flutes 2, by which the lengths C are fed sideways. The drum is rotated in an anti-clockwise direction, as viewed in FIG. 2.

Before entering a flute 2 each length C in turn is engaged by a deflector means 3 driven in a clockwise direction, as viewed in Figure 1, from a drive means (not shown), at a peripheral speed greater than the axial speed of the lengths C.

The deflector 3 consists of a circular body 4 having a recessed cam surface 5 in the form of a snail cam, the surface being radiussed as shown in FIG. 2 so as to fit partly round the circumference of the lengths C. The body 4 is positioned below the cigarette lengths C, which are supported by the cam surface 5 as they are fed into the flutes 2. A portion of the surface 5 is provided with a series of ports 6 which during an appropriate part of each revolution of the body 4 are connected to a source of suction, such as a pump (not shown), through an arcuate aperture 7 formed in a stationary valve disc 8. That portion of the surface 5 which contains the ports 6 is of a constant radius, and thereafter, the radius increases up to an appropriate maximum. In FIG. 3 that portion of the surface 5 containing the suction ports 6 is shown by arc A, and that portion having an increasing radius is shown by arc B. The deflector 3 is positioned adjacent one end of the drum 1 so that cigarette lengths C are fed into a flute 2 at the 3 o'clock position of the drum, as viewed in FIG. 2.

In operation, when each length C engages cam surface 5 the ports 6 start to pass across aperture 7 and suction is applied to grip the length C and accelerate it to create a gap between it and the next succeeding length C. This occurs whilst the body 4 rotates through arc A, and during this time the leading end of the length C enters the upstream end of a flute 2 in drum 1. To allow this to happen the leading wall 2*a* of each flute 2 at the entry end thereof diverges from the trailing wall 2*b* as shown in FIG. 1.

In due course the leading end of the length C is engaged by the trailing wall 2*b* of the corresponding flute 2 into which it is being fed. The length C is from then on given a sideways component of movement in an upward direction by the portion of the surface 5 of increasing radius, i.e. whilst the body 4 rotates through arc B or through the greater part of that arc; at the same time the leading end portion of the length C is pushed sideways by the wall 2*b* of the flute. The rise of the cam surface 5 is such that the sideways velocity imparted to the length C substantially equals that of the flute 2.

The lengths C are subsequently prevented from falling out of the flutes 2 by a cowl 10 and may be brought to rest in the flutes 2 by suction as described in U.S. Pat. No. 3,667,587.

Although, as described above, the constant radius portion of surface 5 is such that purely axial acceleration is applied to each length C over approximately half its length, and sideways movement is imparted over the remainder, these proportions could be changed. They will inevitably change if the same deflector means is used for cigarettes of different length. Thus the proportion of each length C which passes the deflector means before lifting by the same surface starts may be above or below 50%.

If necessary, to alleviate any change of the lengths C becoming misaligned whilst being fed into the flutes 2, a further rotatable body 12 having a cam surface 13 complementary to the surface 5, but without suction, may be positioned above the body 4 as shown in chain-dot lines in FIGS. 1 and 2, so that each length C is confined between the two cam surfaces 5, 13 during transfer to the drum 1.

Instead of being confined to the constant-radius portion of the surface 5, the suction ports 6 may also extend along part or all of the remainder of the surface to continue the suctional grip on the lengths C.

To achieve a similar effect with a helically grooved wheel, for example, as shown in U.S. Pat. No. 3,667,587, the grooved wheel could be modified so that the or each groove consists of a non-helical part for axially accelerating the cigarette lengths, followed by a helical part for imparting the sideways movement, as described below.

Figure 4:
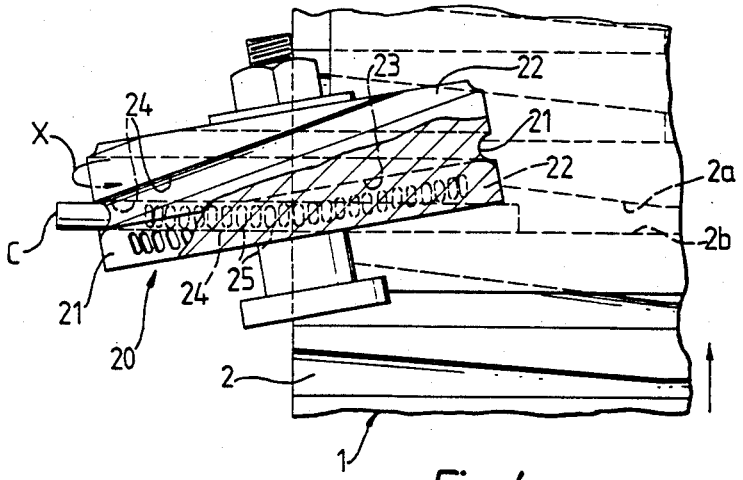
FIG. 4 is a view similar to FIG. 1 showing a different form of cigarette deflector.

Reference will now be made to FIG. 4 in which like parts are given the same reference numerals as in FIG. 1.

A wheel 20, driven in the direction of arrow X, has two grooves 21, 22 formed in its peripheral surface. As the grooves 21, 22 are identical (being 180° apart) only the groove 22 will be described. Considered in the direction of rotation of wheel 20, a first part 23 of groove 22 is formed so as to lie in a plane normal to the axis of rotation of the wheel, whereas a continuation of the groove is formed as a helix 24. The groove 22 is provided with suction ports which are successively connected to a source of suction such as a pump (not shown) through a stationary valve; in known manner, as the wheel rotates.

In operation, as successive cigarette lengths C approach the fluted drum 1 the leading end thereof is engaged by the first part 23 of groove 22 and suction is applied through successive ports 25 to grip the length C and accelerate it axially to create a gap between it and the next succeeding length; for that purpose the wheel is driven at a peripheral speed greater than the speed of the lengths C before they reach the wheel 20. The wheel is positioned, as is the deflector 3 described above, so that the cigarette lengths enter the flutes 2 at the 3 o'clock position of drum 1.

When the leading end portion of each length C is engaged by the trailing wall 2*b* of the corresponding flute 2, it is also engaged by part 24 of groove 22 and is given a sideways component of movement in an upward direction. The lead angle of the helical part 24 of groove 22 is such that the sideways velocity imparted to each cigarette length C substantially equals that of the corresponding flute 2.

We claim:

1. A machine for making cigarettes or other rod-like articles by cutting rod sections from a continuous rod, including a conveyor for carrying the articles sideways, and deflector means for receiving the articles while they are moving axially, feeding them forward at an increased speed onto the conveyor and imparting to the articles a sideways component of movement in the direction of movement of said conveyor, said deflector means including a moving part having an article contacting surface comprising a first portion which is arranged to accelerate, substantially only in an axial direction, each article in contact with said first portion, and a second portion arranged thereafter to contact the article and impart thereto a sideways component of movement substantially in the direction of movement of the adjacent portion of the conveyor.

2. A machine as claimed in claim 1, in which said deflector means is a rotary member.

3. A machine as claimed in claim 2, in which said deflector means is in the form of a snail cam having a peripheral surface which constitutes said article contacting surface.

4. A machine for making cigarettes or other rod-like articles by cutting rod sections from a continuous rod, including a conveyor for carrying the articles sideways, and deflector means which receives the articles while they are moving axially and feeds them forward at an increased speed onto the conveyor and imparts to the articles a sideways component of movement in the direction of movement of said conveyor, said deflector means having an article contacting surface comprising a first portion which is arranged to accelerate, substantially only in an axial direction, each article in contact with said first portion, and a second portion arranged thereafter to impart on each article a sideways component of movement substantially in the direction of movement of the adjacent portion of the conveyor, said deflector means being in the form of a snail cam having a peripheral surface which constitutes said article contacting surface.

5. A machine as claimed in claim 2 in which said first portion of said peripheral surface is of constant radius and is provided with ports through which suction is applied to grip said articles during said axial acceleration, and said second portion of said peripheral surface is of increasing radius such that the velocity of said sideways component of movement of said article is substantially equal to the velocity of said conveyor.

6. A machine as claimed in claim 3 in which said conveyor defines flutes for carrying said articles sideways, the leading wall of each flute at the entry end thereof diverging from the trailing wall of the respective flute.

7. A machine as claimed in claim 4 in which said second portion of said peripheral surface is arranged to impart said sideways component of movement of said articles starting substantially at the moment when the leading end of each successive article comes into contact with the trailing wall of the flute into which it is being fed.

8. A machine as claimed in claim 5 in which said conveyor is a fluted drum arranged to receive the articles at an upwardly moving side of the fluted drum, said first snail cam being positioned adjacent one end of said drum so as to support said articles from below as they are fed into successive flutes of the drum, and said articles are moved in an upward direction to impart to them said sideways component of movement.

9. A machine as claimed in claim 6 in which said second portion of said peripheral surface is provided with ports through which suction is applied to also grip said articles during said sideways component of movement.

10. A machine as claimed in claim 6 in which said deflector means includes a second snail cam, having a peripheral surface of complementary shape to the peripheral surface of said first snail cam, and positioned on the opposite side of said articles to said first snail cam, so as to confine said articles between the peripheral surfaces of said first and second snail cams during transfer to said conveyor.

11. A machine for making cigarettes or other rod-like articles by cutting rod sections from a continuous rod, including a conveyor for carrying the articles sideways, and deflector means which receives the articles while they are moving axially and feeds them forward at an increased speed onto the conveyor and imparts to the articles a sideways component of movement in the direction of movement of said conveyor, said deflector means having an article contacting surface comprising a first portion which is arranged to accelerate, substantially only in an axial direction, each article in contact with said first portion, and a second portion arranged thereafter to impart on each article a sideways component of movement substantially in the direction of movement of the adjacent portion of the conveyor, said deflector means comprising a wheel, the peripheral surface of which has a groove formed in it which constitutes said article contacting surface, wherein a first part of said groove is of a form such that axial acceleration is imparted to said articles and a second part of said groove is of helical form for imparting said sideways component of movement.

12. A machine for making cigarettes or other rod-like articles by cutting rod sections from a continuous rod, including a fluted conveyor means for carrying the articles sideways, first feed means arranged to engage with and accelerate said articles axially, and second feed means arranged to engage with and impart a sideways component of movement to said articles starting substantially at the moment when the leading end portion of each successive article comes into contact with said fluted conveyor means, said engagement by said second means occurring after the articles have disengaged from said first means.

13. A machine as claimed in claim 10 in which said second feed means is arranged to impart to said articles a component of movement sideways at a velocity substantially equal to the velocity of said fluted conveyor means.

14. A machine as claimed in claim 12, in which said fluted conveyor means has flutes at the article inlet ends wider than the articles, and walls so configured that at substantially the moment said second feed means starts to impart the sideways component of movement to said articles, the leading portion of each successive article comes into contact with the trailing wall of the flute into which it is being fed.

15. A machine as claimed in claim 14, in which said first and second feed means are part of an integral rotary member.

16. A machine as claimed in claim 15, in which said second feed means is arranged to impart to said articles a component of movement sideways at a velocity substantially equal to the velocity of said fluted conveyor.

17. In a cigarette making machine having means for delivering axially abutting cigarette portions and a fluted drum for receiving said cigarette portions in flutes thereof to convey the cigarette portions sideways, deflector apparatus comprising first feed means arranged to engage with and accelerate said cigarettes axially, and second feed means arranged to engage with and impart a sideways component of movement to said cigarettes starting substantially at the moment when the leading end portion of each successive cigarette comes into contact with said fluted drum means, said engagement by said second feed means occurring after the articles have disengaged from said first feed means.

18. A machine for making rod-like articles, including conveyor means for carrying the articles sideways, and deflector means for receiving the articles while they are moving axially, feeding them forward at an increased speed onto the conveyor and imparting to the articles a sideways component of movement in the direction of movement of said conveyor, said deflector means having a first article contacting surface for accelerating each article substantially only in an axial direction, and a second article contacting surface to impart the sideways component of movement, there being a smooth, uninterrupted transition between the first surface and the second surface.

19. A machine as claimed in claim 18, in which said conveyor means defines flutes for carrying said articles sideways, the leading wall of each flute at the entry end thereof diverging from the trailing wall of the respective flute such that said second article contacting surface imparts the sideways component of movement when the leading end portion of each successive article comes into contact with the trailing wall of the respective flute into which it is being fed.

* * * * *